US006056503A

United States Patent [19]

Way et al.

[11] Patent Number: 6,056,503

[45] Date of Patent: May 2, 2000

[54] MATERIAL HANDLING VEHICLE

[75] Inventors: Richard Francis Way, Stafford; David John Knight, Staffs, both of United Kingdom

[73] Assignee: J C Bamford Excavators Limited, Staffordshire, United Kingdom

[21] Appl. No.: 08/882,426

[22] Filed: Jun. 25, 1997

[30] Foreign Application Priority Data

Jun. 25, 1996 [GB] United Kingdom ..... 9613327
Apr. 4, 1997 [GB] United Kingdom ..... 9706859

[51] Int. Cl.[7] ..... B66C 1/00

[52] U.S. Cl. ..... 414/722; 414/685; 414/667

[58] Field of Search ..... 414/662–672, 414/685, 722, 723

[56] References Cited

U.S. PATENT DOCUMENTS

| | | | |
|---|---|---|---|
| 2,270,664 | 1/1942 | Weaver . | |
| 4,342,377 | 8/1982 | Goodwin . | |
| 4,948,326 | 8/1990 | Bedard . | |
| 4,986,721 | 1/1991 | Lowder et al. . | |
| 5,072,588 | 12/1991 | Lowder et al. . | |
| 5,147,171 | 9/1992 | Murray et al. . | |
| 5,190,436 | 3/1993 | Sorlie | 414/667 |

FOREIGN PATENT DOCUMENTS

| | | | |
|---|---|---|---|
| 0228208 | 12/1986 | European Pat. Off. . | |
| 0397076 A1 | 11/1990 | European Pat. Off. . | |
| 504527 | 9/1992 | European Pat. Off. . | |
| 2545468 | 9/1984 | France . | |
| 2739537 | 9/1977 | Germany . | |
| 2-209399 | 8/1990 | Japan | 414/667 |
| 930439 | 7/1963 | United Kingdom . | |
| 2040261 | 8/1980 | United Kingdom | 414/667 |
| 2099787 | 12/1982 | United Kingdom . | |
| 2263270A | 7/1993 | United Kingdom . | |

*Primary Examiner*—Donald W. Underwood
*Attorney, Agent, or Firm*—Marshall, O'Toole, Gerstein, Murray & Borun

[57] ABSTRACT

A material handling vehicle comprising a structure having ground engageable propulsion means and a material handling means comprising a boom mounted on the structure for raising and lowering swinging movement relative to the structure and driven for said raising and lowering movement by a first drive means and said boom being extendable and being driven for extension or retraction by a second drive means and a material handling implement carried by an outer end part of said boom, wherein the material handling implement comprises a carrier and a load engageable device moveable relative to the carrier, a first sensing means to sense a first position of the device relative to the carrier, said drive means being responsive to the said first sensing means sensing said first position to modify operation of said drive means.

40 Claims, 10 Drawing Sheets

MATERIAL HANDLING VEHICLE

BACKGROUND TO THE INVENTION

This invention relates to a material handling implement which may be carried by a boom of a material handling vehicle. The material handling implement may have a load engageable device which is engageable with a load for example, a load engageable device may comprise a pair of forks of each of which may be received in, for example, a socket of a pallet or the like or it maybe of a block tine type of the kind commonly used in the USA or maybe any other suitable load engageable device.

The material handling vehicle may be of the kind, hereinafter referred to as being of the "kind specified" comprising a structure having ground engageable propulsion means and a material handling means comprising a boom mounted on the structure for raising and lowering swinging movement relative to the structure and driven for said raising and lowering movement by a first drive means and said boom being extendable and being driven for extension or retraction by a second drive means and a material handling implement carried by an outer end part of said boom.

Generally it is desirable to be able to move the loading engageable device of the material handling implement in a sideways direction for example sideways generally normal to a boom to which the material handling implement may be attached so as to provide a side shift facility to facilitate sideways alignment of the loading engageable device with the load to be handled by the implement.

Such a side shift facility is particularly useful when the implement is intended to be carried by a boom of a material handling vehicle particularly when it is of the kind specified.

When the implement is intended to be used on a rough terrain material handling vehicle the load engageable device is provided so that it can move or float relative to the vehicle to facilitate engagement with the load even when the vehicle is not accurately in aligned with the load by virtue of being provided on rough terrain.

It is desirable that the material handling implement is provided with such a side shift facility which is capable of attachment to or dis-assemble from a material handling vehicle.

It is also desirable to minimise the additional weight to be carried by such a vehicle.

SUMMARY OF THE INVENTION

An object of the present invention is to provide a material handling implement whereby at least one of the above mentioned problems is overcome or is reduced.

According to one aspect of the present invention we provide a material handling implement comprising a carrier, a load engageable device movable relative to the carrier in a sideways direction and side shift means to cause movement of the load engageable device relative to the carrier in said sideways direction.

The load engageable device may be movable relative to the side shift means and fixing means may be provided releasably to fix the load engageable device to the side shift means.

The fixing means may comprise a first set of abutments mutually inter-engageable with at least one further abutment.

Said first set of abutments and at least one further abutment may be fixed relative to one of said load engageable device and said side shift means respectively.

Said fixing means may comprise a dog movable with the load engageable device and releasably engageable with a plurality of teeth fixed relative to the side shift means.

The side shift means may comprise a fluid operated piston and cylinder device.

The load engageable device may be mounted for sideways sliding movement on a bar extending transversely of the carrier and so that the load engageable device is rotatable relative to the carrier.

The load engageable device may be provided with one of said abutments and may be pivotable so as to move said abutments between an engaged and a dis-engaged position whereby the load engageable device may be positioned at a desired sideways position relative to the side shift means.

The bar may be mounted for up and down movement relative to the carrier.

The bar may be non-rotatably connected to the load engageable device and the bar may be rotatable relative to the carrier.

The load engageable device may comprise a pair of sideways spaced elements for engagement with a load.

Each element may comprise a fork.

Each fork may comprise a generally downwardly extending limb connected adjacent one end to the bar and, having at or adjacent the other end, a forwardly extending tine for engagement with a load.

In this case the side shift means may comprise a pair of side shift elements each of which may comprise a piston and cylinder device.

The pair of side shift elements may be inter connected by a member which is non-slideably mounted relative to the carrier.

Where the side shift elements comprise a piston cylinder device the inter connecting member may be a member which provides a pair of piston rods one for each cylinder and may be non-slideably connected to the carrier at a position adjacent its mid point.

The bar may be carried in a slot of a support member adjacent its mid point as may be the member inter connecting the side shift means.

The bar may also be mounted in slots at or adjacent its ends.

According to a second aspect of the invention we provide a material handling vehicle of the kind, hereinafter referred to as being of the "kind specified" comprising a structure having ground engageable propulsion means and a material handling means comprising a boom mounted on the structure for raising and lowering swinging movement relative to the structure and driven for said raising and lowering movement by a first drive means and said boom being extendable and being driven for extension or retraction by a second drive means and a material handling implement according to the first aspect of the invention carried by an outer end part of said boom.

When it is desired to engage or disengage the material handling implement of a vehicle of the kind specified with a load in a predetermined manner, for example, by generally horizontal movement of the material handling implement, this has been achieved hitherto by manipulation by a driver of the vehicle of the above-mentioned drive means as necessary to achieve the predetermined movement with a consequent problem arising from the need for at least one of the exercise of skill, the expenditure of time, inconvenience of operation.

Another object of the present invention is to provide a material handling vehicle of the kind specified whereby the above-mentioned problem is overcome or is reduced.

According to a third aspect of the present invention, we provide a material handling vehicle of the kind specified wherein the material handling implement comprises a carrier and a load engageable device moveable relative to the carrier, a first sensing means to sense a first position of the device relative to the carrier, said drive means being responsive to the said first sensing means sensing said first position to modify operation of said drive means.

The material handling implement may comprise a second sensing means to sense a second position of the device relative to the carrier and the control valve may be operable in response to said second sensing means sensing said second position to modify operation of said drive means.

The vehicle may comprise means to operate at least one of said drive means to cause relative movement between said carrier and device and wherein said drive means is responsive to said first sensing means to cause or increase operation of the other of said drive means.

The modification of operation of said drive means may comprise cessation of operation of the one drive means and initiation of operation of the other of the drive means.

Alternatively, the rate of operation of the one drive means may be constant and operation of the other drive means may be initiated.

Further alternatively, the rate of operation of the one and other drive means may be variable so that the rate of operation of the one drive means may be decreased and the rate of operation of the other drive means may be increased, or vice versa.

Said first or said first and second sensing means may comprise a proximity switch.

The first or first and second sensing means may detect relative movement between the load engageable device and the carrier in a direction having a vertical translatory component and/or angular movement of the load engageable device relative to the carrier.

The vehicle may have a third sensing means to determine a predetermined orientation of the carrier relative to vertical.

The vehicle may comprise a mode sensing means to determine the angular orientation of the boom relative to vertical.

The mode sensing means may be adapted to modify the response of the control valve means to said first or said first and second sensing means.

The vehicle may comprise a control valve means under operator control to be operable to cause operation of said drive means for said engagement or disengagement of material handling implement.

The control valve means may include an operating lever, a position of which to extend a boom may be detectable and connectable to a control means so as to modify said operation of the drive means.

The carrier may be angularly adjustable relative to the boom for crowd or dump movement by a crowd drive means.

A material handling vehicle according to said third aspect of the invention may be provided with a material handling implement according to the first aspect of the invention.

The intermediate member of the carrier may carry a sensor to sense up and down movement of the load engageable device as well as rotation thereof above the axis of the bar.

A mechanical handling implement and a mechanical handling vehicle embodying the invention will now be described by way of example with reference to the accompanying drawings wherein

DESCRIPTION OF THE PREFERRED EMBODIMENTS

Figure 1:
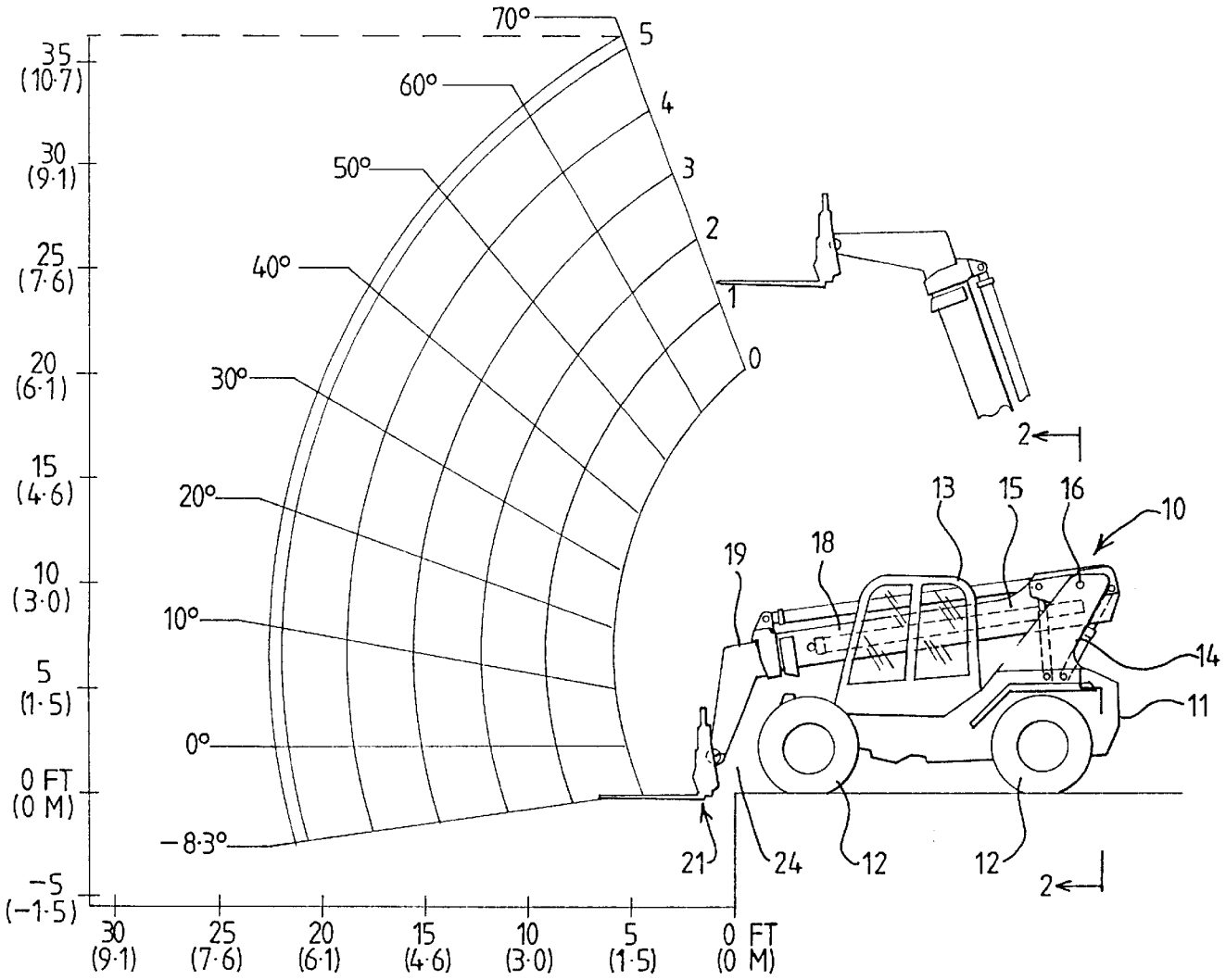
FIG. 1 is a diagrammatic illustration of a material handling vehicle embodying the invention and showing graphically alternative positions of a load handling implement therefore.
Figure 3:
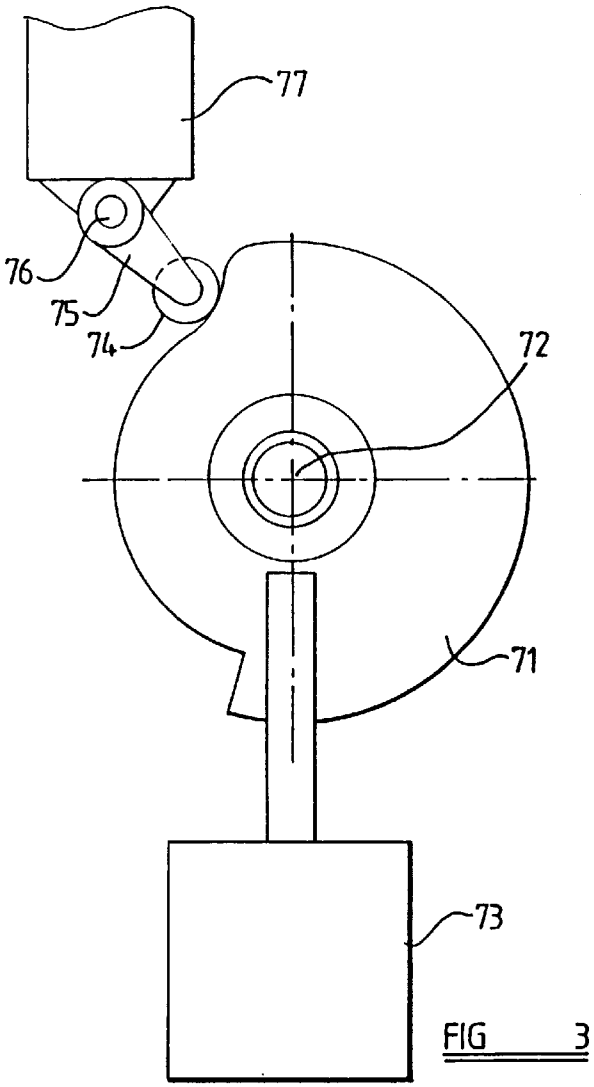
FIG. 3 is a fragmentary diagrammatic side view, drawn to a still larger scale, and looking in the direction of the arrow "A" in FIG. 2.
Figure 2:
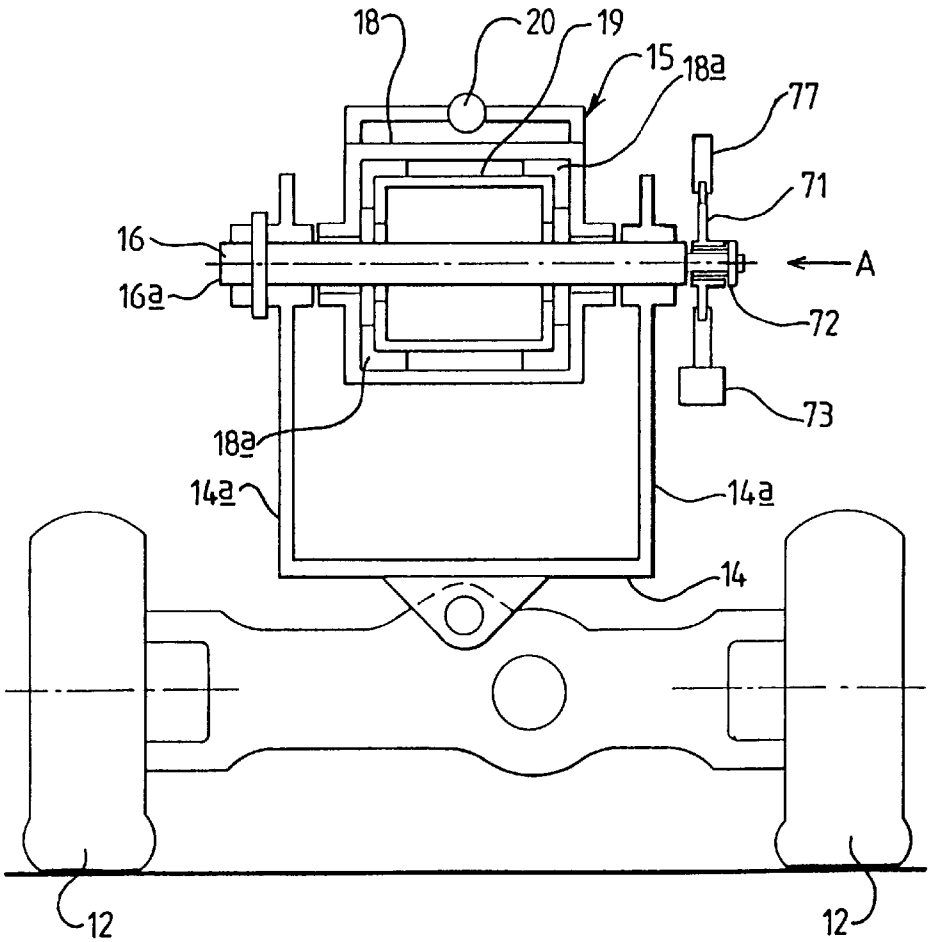
FIG. 2 is a diagrammatic section on the line 2—2 of FIG. 1 drawn to an enlarged scale.

Referring to FIGS. 1 to 7, a material handling vehicle is shown generally at 10 in FIG. 1 and comprises a body structure 11 having ground engageable propulsion means 12 comprising front and rear wheels which are driven from a prime mover, not shown, in conventional manner. The structure 11 has a driver's cab 13 of generally conventional configuration and a rear part of the structure, which may comprise a chassis 14, is provided with a pair of uprights 14*a* on which is mounted a material handling means comprising an extendable loader arm in the form of a boom 15 mounted on the chassis 14 for raising lowering and swinging movement relative to the structure about a horizontal axis 16 which is perpendicular to the fore and aft axis of the vehicle. In this example, the horizontal axis 16 is provided by a pivot axle shown at 16*a* which is fixed to the uprights 14*a* on which the boom 15 is free to rotate. The boom 15 is driven for said raising and lowering movement by a first drive means comprising an hydraulic ram 17.

Figure 4:
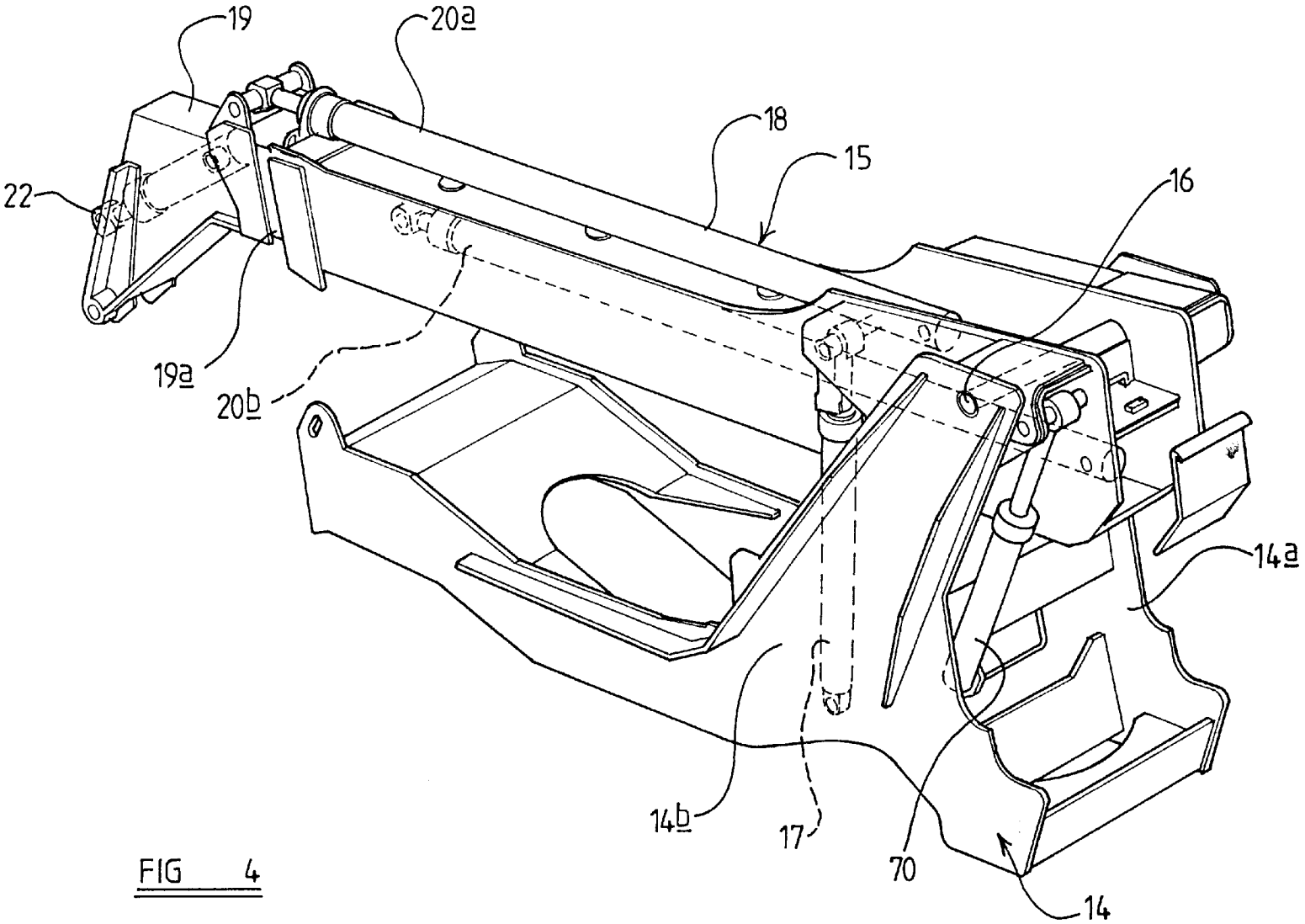
FIG. 4 is a fragmentary perspective view with parts omitted for clarity showing part of the vehicle shown in FIG. 1.

The boom 15 is extendable comprising a rearward part 18 in which forward part 19 is telescopically slidably mounted in conventional manner. If desired, and as illustrated, the boom 15 may be in three parts, there being an intermediate part 19*a* between the rearward and forward parts 18,19 respectively. The intermediate part 19*a* is driven for extension or retraction within the rearward part 18 by a ram 20*a* of a second drive means 20, best shown in FIG. 4, whilst the forward part 19 is driven for extension or retraction relative to the intermediate part 19*a* by a ram 20*b* of the second drive means 20. As best shown in FIG. 4, the ram 20*a* is disposed exteriorly to the rearward boom part 18 and the intermediate boom part 19*a*, whilst the ram means 20*b* is disposed interiorly of the intermediate and forward boom parts 19*a*,19 respectively. A compensating ram 70 is pivotally connected between the rearward part of the boom 15 and the chassis 14 on the opposite side of the pivot axis 16 to the forward end of the boom.

A cam 71 is mounted on an extension part 72 of the pivot axle 16*a* so as to be free to rotate relative thereto under the influence of a pendulum mass 73. A cam follower roller 74 is carried on an arm 75 which is pivoted at 76 to a body of a switch 77 carried on a bracket (not shown) to determine the angular orientation of the boom 15 relative to the vertical.

A suitable proximity switch arrangement may be provided to minimise any affect on operation of the pendulum device instead of the mechanical arrangement described above.

The material handling means also comprises a material handling implement 21 pivotally mounted on the outer part 19 of the boom for relative angular adjustment for operator induced crowd or dump movement by means of a crowd ram means 22 connected between the implement 21 and the outer part 19 of the boom for said pivotal adjustment about a horizontal axis 24 which is parallel to the axis 16. The crowd ram means 22 is connected in series circuit with the compensating ram 70 thus, in use, the material handling implement 21 is maintained in a fixed juxtaposition relative to the chassis of the vehicle irrespective of raising or lowering movement of the boom 15 about the axis 16, so long as a valve 48 for operator induced crowd movement of the ram means 22 is not implemented.

Figure 5:
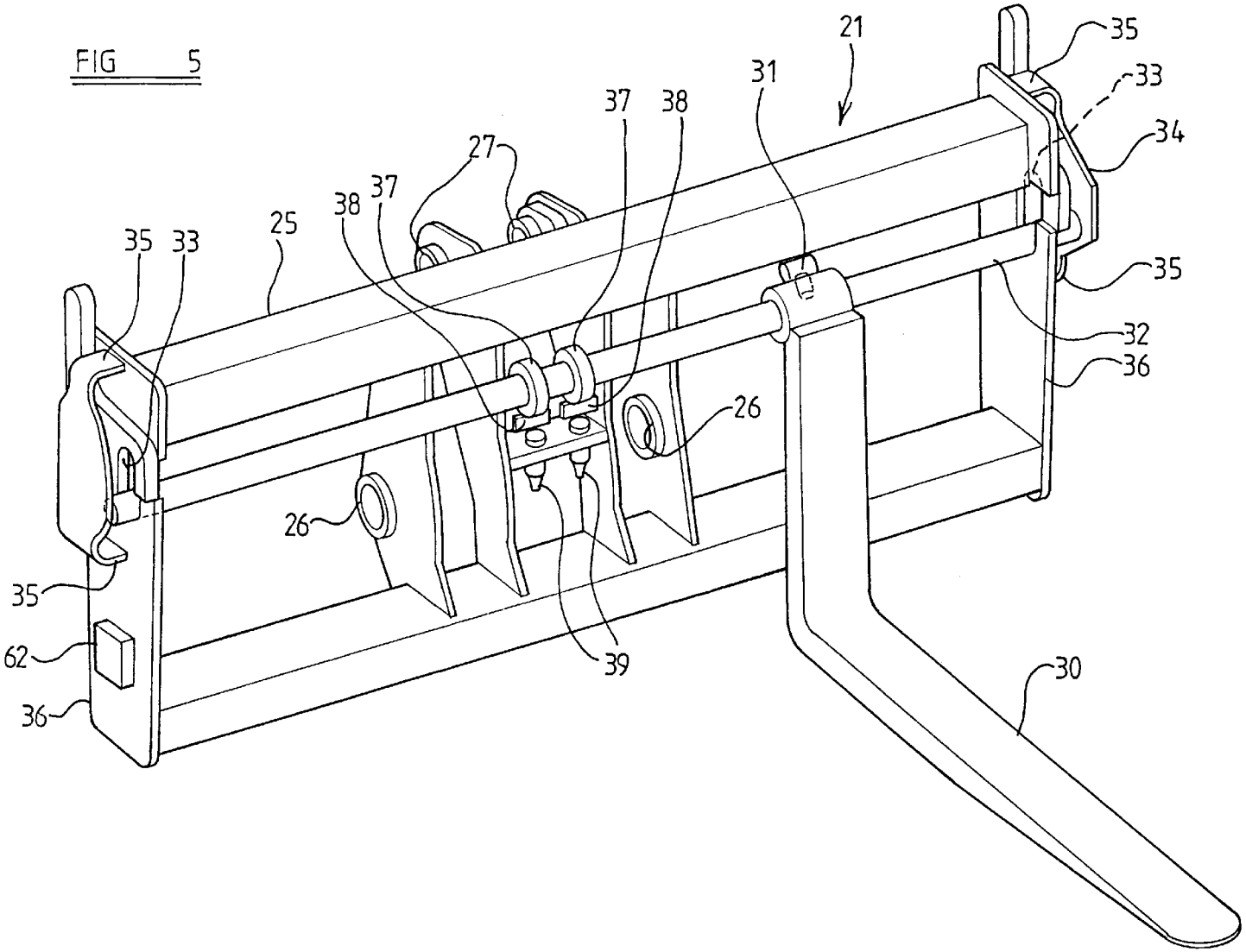
FIG. 5 is an enlarged, perspective view showing a material handling implement of the vehicle of FIG. 1 with parts omitted for clarity.

The mechanical handling implement 21 comprises, as best shown in FIG. 5, a carrier 25 providing a means 26 to receive a pivot pin for pivotal movement of the carrier 25 about the axis 24 and a means 27 to pivotally connect the crowd ram 22 thereto. The carrier 25 has mounted thereon, or relative thereto, a load engageable device 30 which in the present example comprises a pair of forks, only one of which is shown for clarity in FIG. 5. Each fork 30 is clamped, for transverse adjustment, by a suitable lock screw 31 to a bar 32 which, in the present invention, is mounted adjacent the opposite end of the bar, for up and down movement in a pair of longitudinally extending slots 33. The bar 32 is retained in the slots 33 by end plates 34 which are fastened in a convenient manner by lugs 35 to side wall parts 36 of the carrier 25.

The bar 32 is also pivotable relative to the carrier within the slots 33 and carries a pair of collars 37 for rotation with the bar 32. Each collar 37 has a target 38 mounted thereon for rotation with the bar 32 and for up and down movement with the bar 32. The angular position of one of the targets 38 is detectable in conventional manner by one proximity device 39, whilst the up and down position of the other of the targets 38 is detected, in conventional manner, by a second proximity device 39. The proximity devices 39 are mounted on the carrier. In the present example, one of the proximity devices is adapted to be most sensitive to angular movement of a target 38 whilst the other proximity device is most sensitive to up and down movement of the associated target 38. Accordingly, if, as hereinafter to be described, a pallet is engaged primarily with a tip part of a fork 30 so that a maximum amount of rotation takes place, then the relevant proximity device will be operable, whilst when the fork 30 is fully engaged with the pallet so that primarily up and down movement of the bar 32 occurs then, again, the relevant proximity device is operated.

Alternatively, if desired only a single proximity device may be provided of appropriate sensitivity to both modes of operation as described hereinbefore.

If desired, alternatively, or in addition, the proximity devices may be provided adjacent the top and bottom of the slots or at least one slot 33 so that the position of the bar 32 relative to the top or the bottom of the slot 33 can be detected.

If desired, the forks 30 may, instead of being provided in a form of conventional pallet forks adapted to be received in a socket of a pallet, be a of a block type of the kind commonly used in USA, or may be of any other suitable load engageable device.

Figure 6:
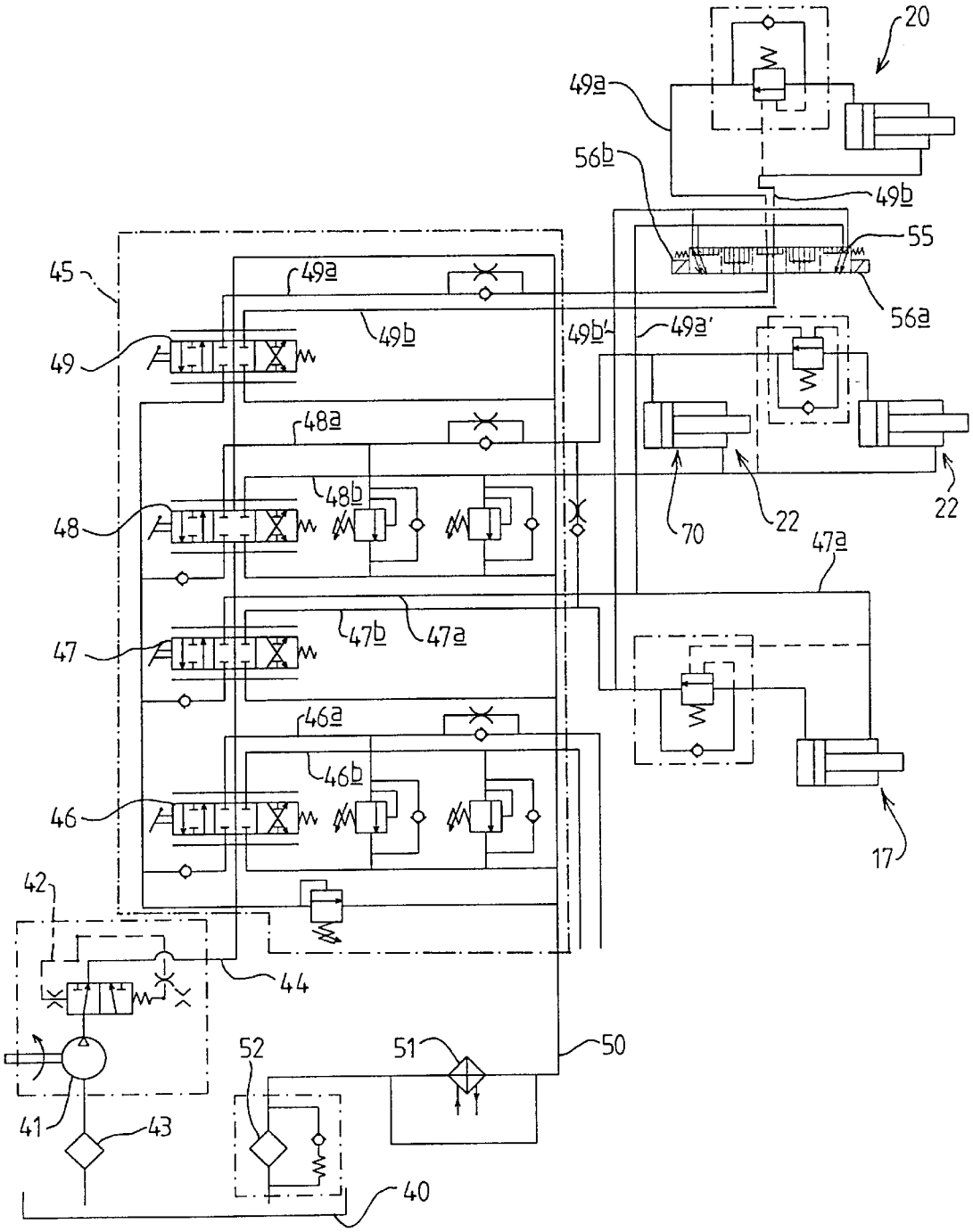
FIG. 6 shows a fragmentary hydraulic circuit of the vehicle of FIGS. 1 and 2.

Referring now to FIG. 6, the hydraulic circuit or the hydraulic rams 17, 20 and 22 is illustrated and will now be described.

The hydraulic circuit comprises a reservoir 40 from which hydraulic fluid is fed by a main pump 41 via a load sensing valve 42, and a suction strainer 43 in conventional manner so as to be fed on a line 44 to a four-spool valve block 45. Within the valve block 45 are four manually operable valves 46–49. Hydraulic fluid is fed under pressure from the line 44 by operator actuation of the valve 46–49 in the appropriate direction to the appropriate one of the exit lines 46*a*, 46*b*–49*a*,49*b* respectively and hence to the respective side, under pressure, of the associated ram. Fluid is returned from the appropriate other side of the ram on the other line 46*a*,46*b*–49*a*,49*b* and hence on return line 50 via a cooler 51 and a return line filter 52 to the reservoir 40.

In the present example, the valve 46 is connected to a ram, not shown, in order to provide a desired auxiliary function.

The valve 47 is connected to the lift ram means 17 so that when the line 47*a* is pressurised the boom is lowered whilst when the line 47*b* is pressured ram means 17 is raised.

The valve 48 is connected to crowd ram means 22 so that when the line 48*a* is pressurised the ram means 22 is operated to dump the mechanical handling implement, whilst when the line 48*b* is pressurised the mechanical handling implement is actuated in a direction so as to crowd the mechanical handling means, ie, referring to FIG. 1, mechanical handling implement 21 is pivoted in a clockwise direction for crowding and an anti-clockwise direction for dumping. Superimposed on the crowd ram means 22 is the series connection of the compensating ram 70.

The valve means 49 is connected to the ram means 20 for extension of the boom and is arranged so that when the line 49*a* is pressurised, the boom is extended, whilst when the line 49*b* is pressurised, the boom is retracted.

A three position flow diverter valve means 55, operable by solenoid means 56*a* and 56*b*,is connected in the line 49*a*,49*b* so that the lines 49*a*,49*b* are connected respectively by lines 49*a*',49*b*' to the lines 47*a*,47*b* which lead to the boom raise and lower ram means 17 when either solenoid means 56*a* or 56*b* is energised. It will be noted that lines 49*a*,49*b* are connected respectively, to lines 49*a*',49*b*' when solenoid means 56*a* is energised, but are connected, respectively, to lines 49*b*',49*a*' when solenoid means 56*b* is energised.

Figure 7:
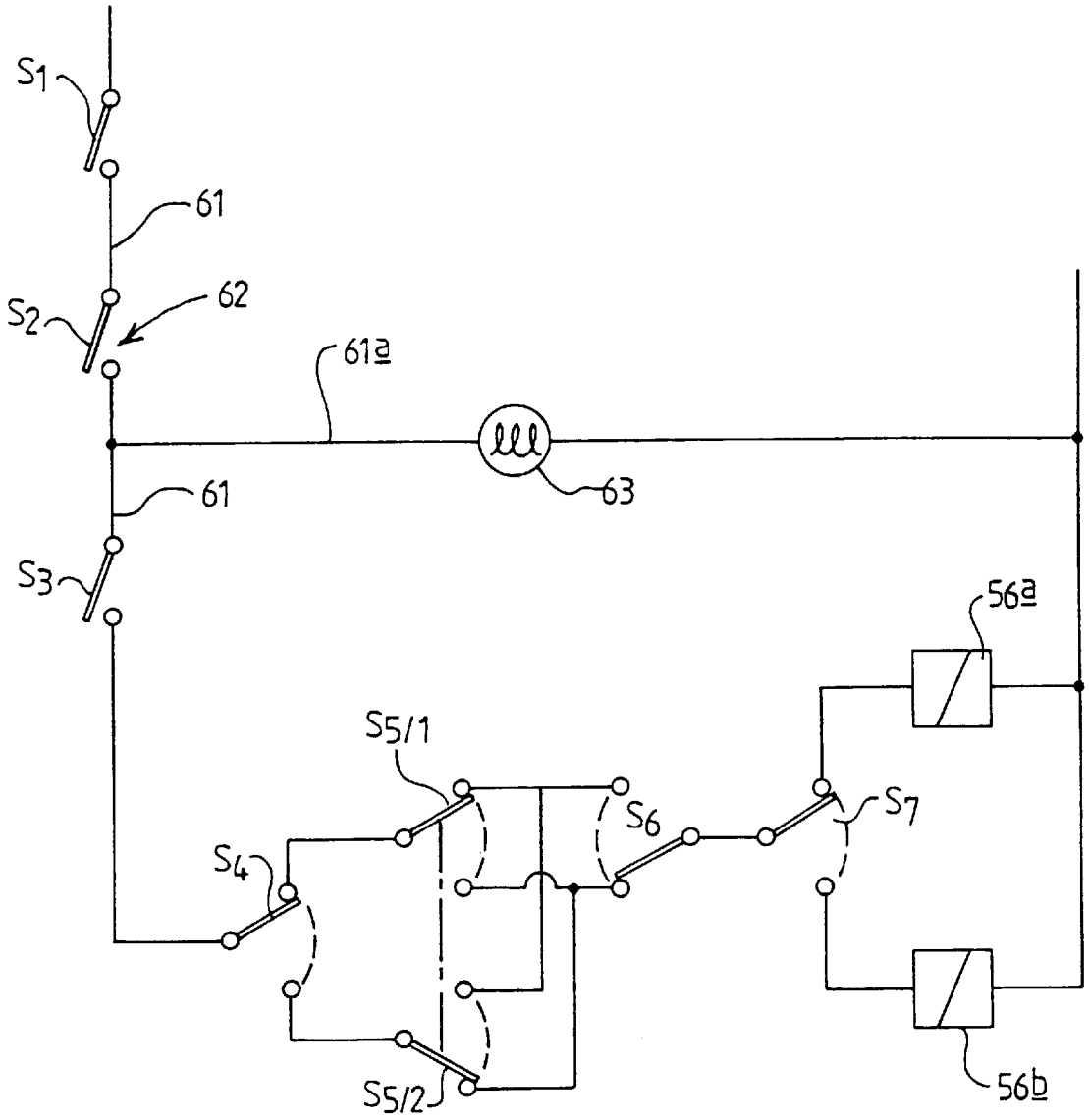
FIG. 7 shows a fragmentary electrical circuit of the vehicle of FIGS. 1 and 2.
Figure 8:
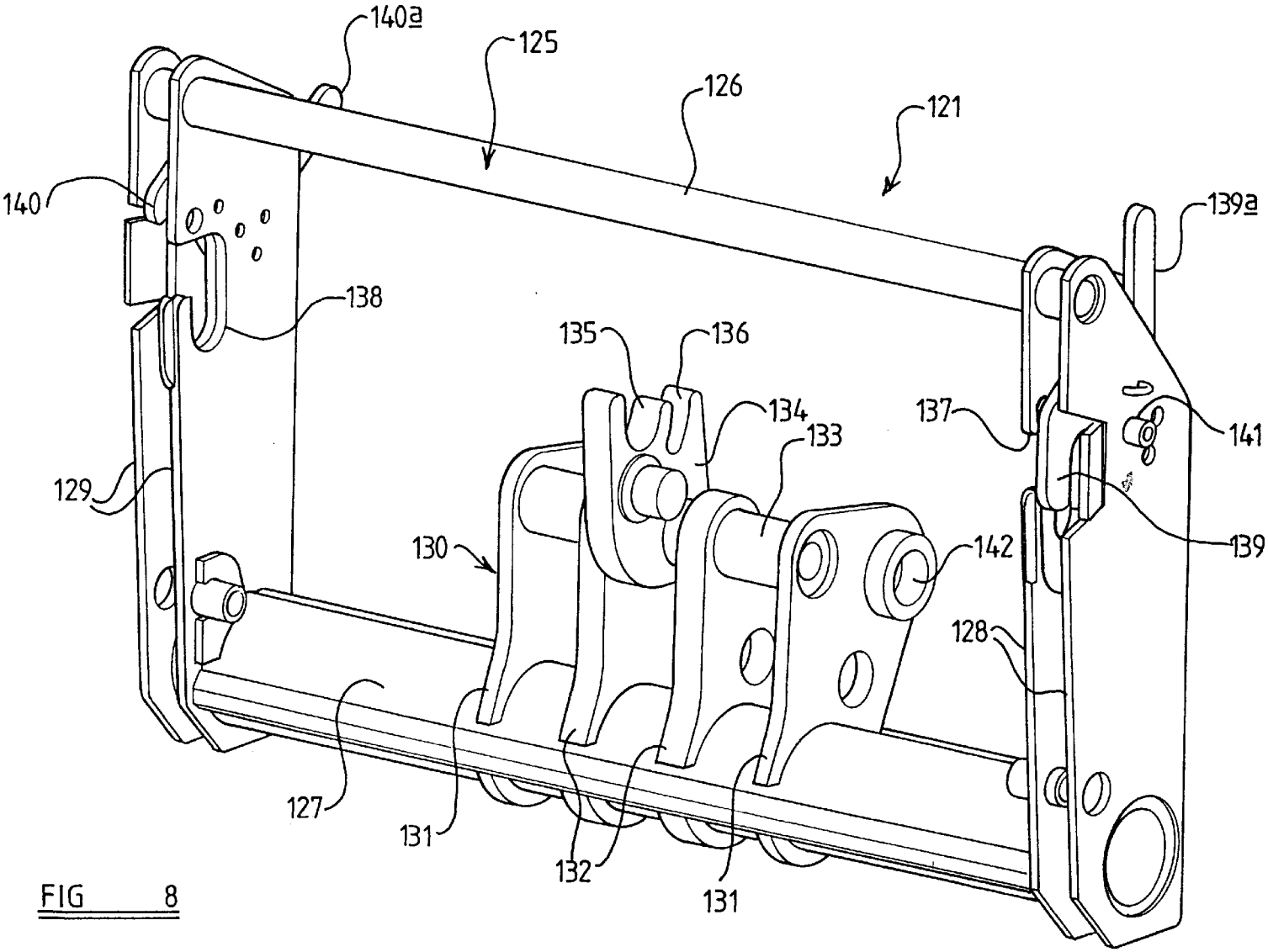
FIG. 8 is a perspective view showing a carrier of an alternative material handling implement which may be used in the machine of FIGS. 1 to 7.

Referring now to FIG. 7, there is shown an electrical circuit in which item S1 comprises a manually operable system enabling switch from which, when manually closed, current is fed via a line 61 to a pendulum switch device 62 provided on the carrier and shown in FIG. 5 and referred to in FIG. 7 as switch S2 and which detects whether or not carrier 25 is vertical. If the carrier 25 is detected as vertical, the switch S2 is closed and current is fed on a branch line

61*a* to a retract/extend engage system available light 63 and on an extension of the main circuit 61 to a manually operable extend/retract selection switch S3 provided on a lever of the hydraulic valve 49.

The circuit 61 extends from switch S3 to a fork proximity switch S4 provided by the proximity device(s) 39 which is connected in circuit with a boom, lower quadrant, double changeover switch shown at S5/1 and S5/2 in FIG. 7 and provided by the switch 77.

Outputs from one contact of the double switch S5/1, S5/2 extend to one contact of an extend switch S6 operated as a result of movement of an operating member of the valve 49 in the direction to cause extension of ram 20, whilst the other contacts of the switches S5/1, S5/2 extend to a second contact of the extend switch S6. The output from the switch S6 extends to a boom upper quadrant switch S7 provided by the switch 77, one contact of which is converted to the solenoid 56*a* of the valve 55, whilst the other contact of the boom upper quadrant switch S7 is connected to solenoid 56*b* of the valve 55.

In FIG. 7, the schematic electric circuit indicates a situation where, for the sake of example, the boom 15 is in its upper quadrant and the forks 30 are at rest in the bottom of the slots 33 with no tilting of the forks 30 taking place away from the carrier. In this condition, all the devices are considered to be in a "0" state, whilst any change in state is indicated by "1". Furthermore, it is to be noted that the solenoid 56*a*,56*b* of the valve 55 are required to be in the positions indicated in Table 1 to "engage" or "disengage" the forks 30 in respect of a socket means of a load.

TABLE 1

| | | | |
|---|---|---|---|
| Upper Quadrant | Neither | A nor B = Retract | ) Disengage |
| Upper Quadrant | | A not B = Lift | ) |
| Upper Quadrant | | A not B = Lower | ) Engage |
| Upper Quadrant | Neither | A nor B = Extend | ) |
| Lower Quadrant | | B not A = Lower | ) Disengage |
| Lower Quadrant | Neither | A nor B = Retract | ) |
| Lower Quadrant | | B not A = Lift | ) Engage |
| Lower Quadrant | Neither | A nor B = Extend | ) |

Table 2 sets out the necessary conditions of the various components to achieve the desired functions by operating the control member of the valve 49 to engage or disengage the load as desired.

TABLE 2

| | UPPER QUADRANT | | | | LOWER QUADRANT | | | |
|---|---|---|---|---|---|---|---|---|
| | Disengage | | Engage | | Disengage | | Engage | |
| S1 | 1 | 1 | 1 | 1 | 1 | 1 | 1 | 1 |
| S2 | 1 | 1 | 1 | 1 | 1 | 1 | 1 | 1 |
| S3 | 1 | 1 | 1 | 1 | 1 | 1 | 1 | 1 |
| S4 | 0 | 1 | 0 | 1 | 0 | 1 | 0 | 1 |
| S5/1 | 0 | 0 | 0 | 0 | 1 | 1 | 1 | 1 |
| S5/2 | 0 | 0 | 0 | 0 | 1 | 1 | 1 | 1 |
| S6 | 0 | 0 | 1 | 1 | 0 | 0 | 1 | 1 |
| S7 | 0 | 0 | 0 | 0 | 1 | 1 | 1 | 1 |
| Sol A | 0 | 1 | 1 | 0 | 0 | 0 | 0 | 0 |
| Sol B | 0 | 0 | 0 | 0 | 1 | 0 | 0 | 1 |
| Retract | 1 | 0 | 0 | 0 | 0 | 1 | 0 | 0 |
| Extend | 0 | 0 | 0 | 1 | 0 | 0 | 1 | 0 |
| Lift | 0 | 1 | 0 | 0 | 0 | 0 | 0 | 1 |
| Lower | 0 | 1 | 1 | 0 | 1 | 0 | 0 | 0 |

In Table 2 there are two fundamental modes. On the left-hand side of the function part of Table 2 there are stated the conditions required for disengagement of the forks from a load such as a pallet, or engagement of the forks into such a load when the boom is in its upper quadrant, ie above horizontal, whilst on the right-hand side of the function part of Table 2 the conditions required are stated for when the boom is in its lower quadrant and the forks are required to disengage from the load or engage with the load.

Of course, when it is desired to engage the load engageable device 30 with a load, an end part of the load engageable device 30 must initially be manipulated manually into engagement with the load.

When it is desired to disengage the load engageable device 30 and the boom is in its upper quadrant. The conditions are as shown in the first, ie left-hand, column of Table 2. The valve 49 is initially operated so as to pressurise the line 49*b* so as to cause the ram 20 to retract the boom until, in accordance with a signal from the sensors 39. The state of switch S4 is changed so that the conditions of column 2 of Table 2 apply and, hence, the solenoid 55*a* is actuated so as to feed fluid from line 49*b* on to line 49*b*' so as to raise the boom using the ram 17. Then when the sensors 39 detect that the forks 30 have reached the bottom of their extent of movement the state of the switch S4 is again changed back to the first column of Table 2 condition and the solenoid 56*a* is de-energised and retraction of the boom 15 recommences. The procedure is repeated as necessary.

When the boom is in its upper quadrant and it is desired to engage the load, the conditions of column 3 of Table 2 apply. The valve 49 is initially operated in the reverse direction to that described previously which changes the state of the switch S6 to the condition shown in the third column of Table 2, which causes the solenoid A to be energised so that operation of the valve 49 causes fluid pressure to be relieved in the line 49*b*' and this relieved pressure to be returned to the valve 49 on line 49*b* so that the boom is lowered. This continues until, in accordance with a signal from the sensors 39, switch S4 changes state to the condition shown in the fourth column of Table 2 so that solenoid 56*a* is de-activated to de-energise the boom lowering action and to start the boom extension action since fluid pressure will be reduced on line 49*b* and increased on line 49*a*. This continues until the sensors 39 sense that the forks have reached the bottom of their extent of movement so that the conditions of the third column of Table 2 re-apply an extension of the boom is interrupted and operation of boom lowering continues as described previously.

Conversely, when the boom is in its lower quadrant, operation of the valve 49 to disengage the forks from the pallet causes the conditions of column 5 to apply. Accordingly, initially solenoid B is energised so that operation of the valve 49 initially causes the boom to lower because the pressure in line 49*b*' is reduced which is transmitted by the valve 55 to the line 49*a*. This continues until the proximity sensors 39 cause the switch S4 to change state to the conditions shown in the sixth column of Table 2, whereupon neither solenoid A nor solenoid B are activated so that the above-mentioned reduction in pressure in line 49*a* is transmitted to the ram 20 on the larger diameter side thereof so as to cause retraction of the boom. This continues until the sensors 39 again cause the switch S4 to change state back to the condition shown in column 6 of Table 2, whereupon the retraction of the boom is interrupted and lowering of the boom continues.

Finally, when the boom is in the lower quadrant and is desired to engage the load, initially operation of the valve 49, in the opposite direction to that described in the preceding paragraph, causes the conditions of column 7 to apply so that neither solenoid is energised so that, in this case, increase in pressure in the line 49*a* is transmitted to the larger diameter size of the ram 20 to cause extension of the ram and, hence, of the boom. This continues until the sensor 39 causes the switch S4 to change state so that the conditions shown in the eighth column of Table 2 apply and the solenoid B is energised. As a result, fluid under pressure in line 49*a* is supplied to line 49*b*' and hence to the larger diameter side of the lifting ram 17 and thus causes lifting of the boom to occur. This continues until the sensors 39 cause reversion to the condition shown in column 7 of Table 2, whereupon lifting of the boom is interrupted and extension repeated.

If the boom 15 is horizontal then operation of the valve 49 in the direction to pressurise the line 49*a* causes the ram means 20 to be extended and will cause the load engageable device 30 to engage in, for example, a socket of a pallet without requiring any angular movement of the boom. Similarly, if it is desired to retract the load engageable implement 30 it is simply necessary to operate the valve 49 to pressurise the line 49*b* to cause retraction of the ram 20.

If desired, relays may be provided.

Although in the above-described example the diverter valve 55 is an on/off valve so that it operates in only one of the desired three positions, if desired it may be provided as a proportional valve so that the amount of fluid flowing to the outlets described hereinbefore can be proportioned as desired, according to the extent of movement of the valve.

Furthermore, if desired, instead of the valve 55 interrupting the fluid flowing to first outlets in initial condition, the fluid flowing in the initial condition may continue to flow in the second condition, with the fluid flowing to second outlet of the second condition, in addition to the fluid flowing to the first outlets of the first condition.

Referring now to FIGS. 8 to 11 there is illustrated and described below an alternative form of material handling means which may be used in place of the material handling implement 21 described hereinbefore or which may be used independently of a material handling vehicle of the kind described and as described and illustrated herein, before as the material handling implement of FIGS. 8 to 11 may be capable of being attached to or disassembled from a tool carrier or carriage of any desired vehicle.

Referring now to FIGS. 8 to 11 the material handling means comprises a material handling implement 121 which, as mentioned before may be mounted in the same manner as the material handling implement 21 or in any other desired manner. The implement 121 comprises a carrier 125 comprising an upper cylindrical bar 126 connected to a lower cylindrical bar of larger diameter 127 by a first pair of side plates 128 on one side of the carrier and a second pair of side plates 129 at the opposite side of the carrier.

The lower bar 127 has a fabrication 130 welded thereto. The fabrication 130 comprises a pair of end members 131 and a pair of intermediate members 132. A torsion bar 133 is received in appropriate apertures of the members 131, 132 and is welded thereto and carries a slotted element 134. The slotted element 134 has a first slot 135 and, disposed to the rear thereof a second slot 136. The slot 135 is aligned with a pair of slots 137, 138 provided in the inner plates 128, 129 whilst a latch member 139, 140 is pivotally mounted by a pivot pin 141 between the plates 128, 129 respectively. The latch members 139, 140 have a hand engageable member 139*a*, 140*a* respectively and the member 139 is shown in an operative position whilst the member 140 is shown in an inoperative position. The members 131 and 132 provide, as shown at 142, a pair of bosses for connection to a loader arm, if desired, in a manner similar to the bosses 26 shown in FIG. 5.

Figure 9:
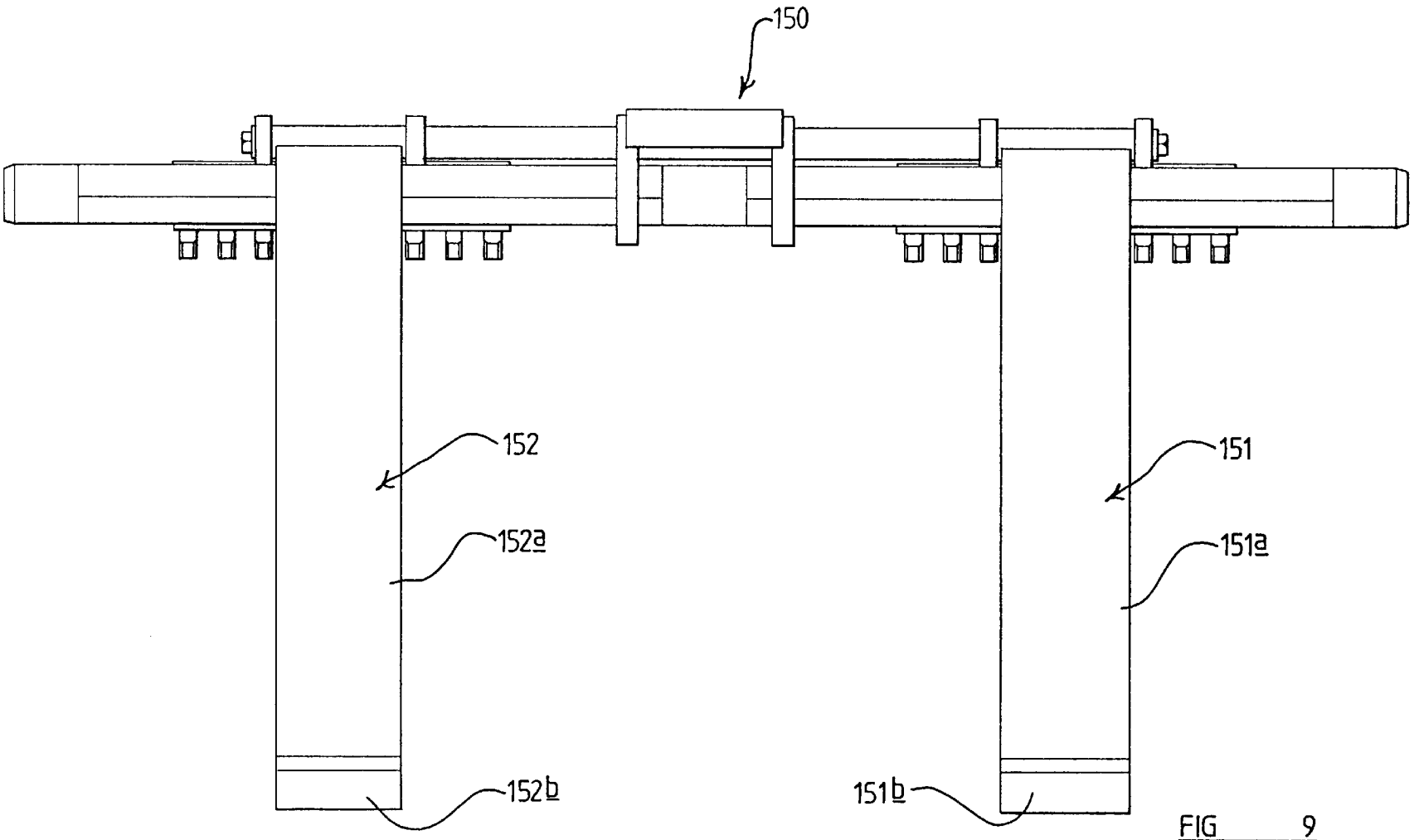
FIG. 9 is a front elevation showing a loading engageable device for use with the carrier of FIG. 8.
Figure 10:
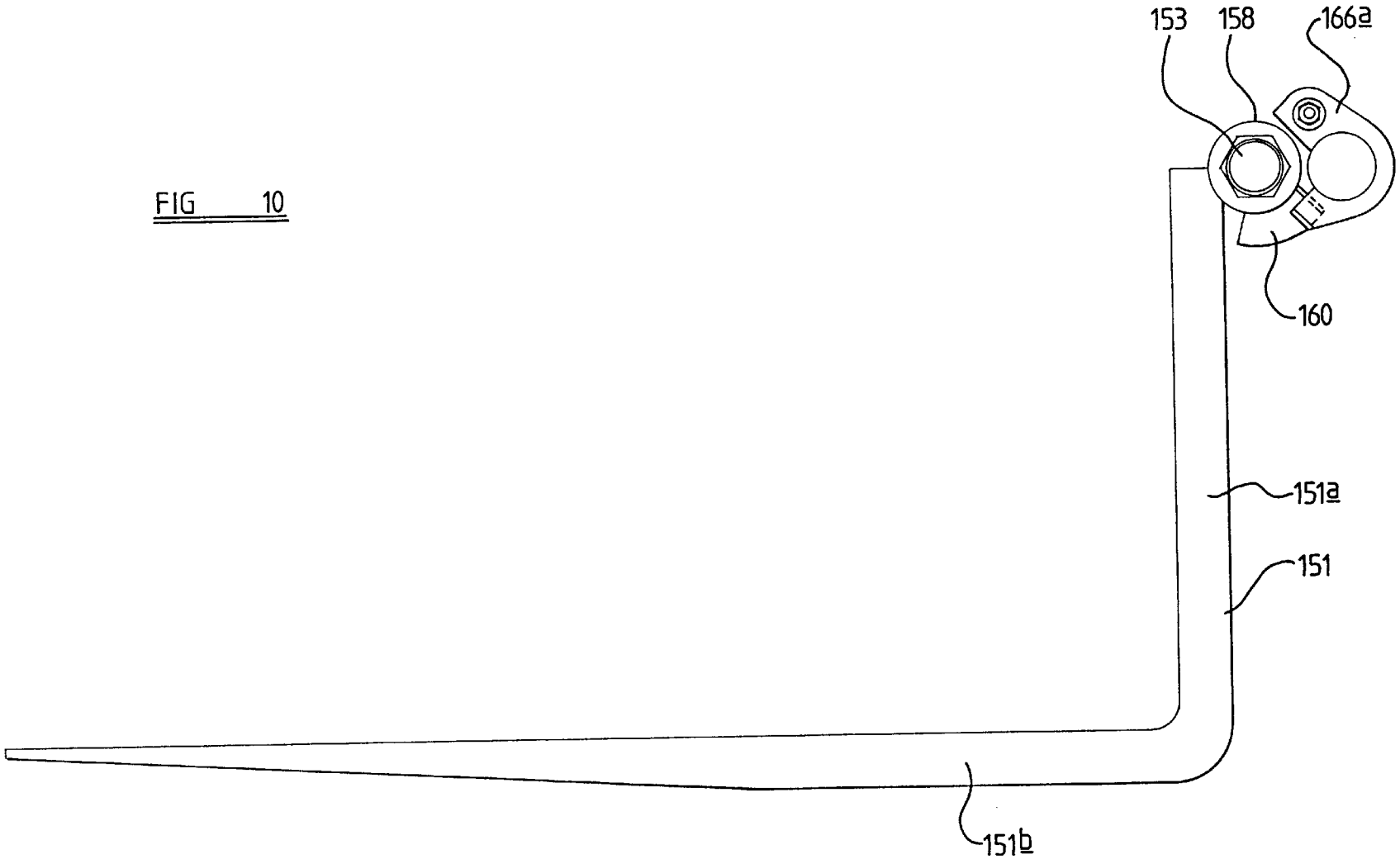
FIG. 10 is a side view of the device of FIG. 9.
Figure 11:
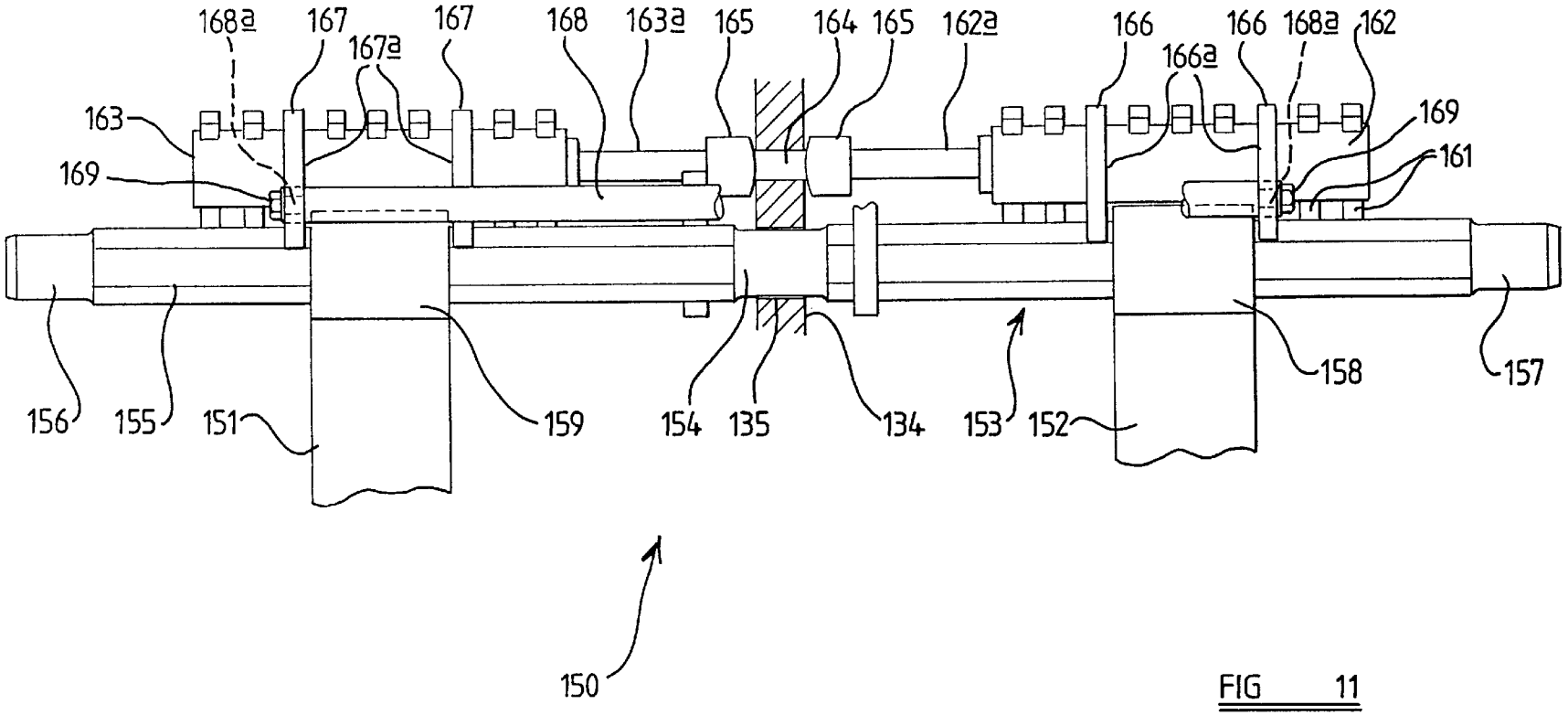
FIG. 11 is a plan view of the device of FIG. 9 and showing a part of the carrier of FIG. 8 in cross section.

Referring now to FIGS. 9 to 11, releasably mounted on the carrier 121 is a load engageable device 150 which comprises, in the present example, a pair of forks 151, 152. The load engageable device 150 also comprises a bar 153 which is received within the slot 135 of the member 134 at a reduced diameter part 154 thereof adjacent the mid point. The bar 153 is of hexagonal section over the majority of its length 155 but has circular end portions 156, 157. The end portions 156, 157 are received within the slots 137, 138 and are retained therein by the latches 139, 140 when they are in their operative position. As a result the bar 153 is free to move up and down or float relative to the carrier 125 and can also rotate relative thereto. Axial movement of the bar is prevented by engagement of the reduced diameter part 154 in the slot 135 whilst up and down movement is permitted by virtue of the shape of the slot 135.

The forks 151, 152 comprise a downwardly depending part 151*a*, 152*a* and a load engageable part 151*b* 152*b* which extends perpendicularly forwardly relative to the downwardly extending part 151. The downwardly extending parts 151*a* 152*a* have at their upper end a boss part 158, 159 respectively welded thereto, having an hexagonal bore so as slideably and non rotatably to receive part 155 of the bar 153. As a result the forks 151, 152 may be slid sideways manually relative to the bar 153 and hence relative to the carrier 121.

The tubular part 158, 159 is provided with a dog 160 which is engageable between a desired pair of a plurality of teeth 161 which extend part circumferentially around first and second cylinders 162, 163 of piston and cylinder devices. The piston rods 162*a*, 163*a*, of which are interconnected by, in the present example, a reduced diameter portion 164 which is received within the slot 136 of the member 134 of the carrier and member 134 being received between *a* pair of abutments 165 fixed to their respective piston rod 162*a*, 163*a*. Of course the means whereby the piston rods and the member 164 are connected together may be provided as desired and indeed the components may be provided integrally with each other if desired.

Each cylinder 162, 163 has a pair of mounting elements 166, 167 respectively which are provided as extensions of a pair of the teeth 161 and have lugs 166*a* 167*a* which are provided with apertures which are to receive a rod 168. The rod 168 has a reduced diameter end part 168*a* at each end which is received within a correspondingly dimensioned aperture of the outer of the lugs 166*a* 167*a* and which is clamped by a bolt 169 against a shoulder between the main part of the rod 168 and the reduced diameter parts 168*a*. The inner of the lugs 166*a*, 167*a* are provided with an aperture in which the main part of the rod 168*a* is received.

The rod 168 thus serves to link the cylinders 162, 163 together.

In use, the forks 151,152 may be pivoted upwardly ie. in a clock wise direction as shown in FIG. 10 so as to disengage the respective dog 160 from a pair of the teeth 161. It will be appreciated that pivotal movement of one of the forks will result in pivotal movement of the other fork because of the non rotational engagement between the forks and the bar 153.

With the forks thus disengaged the spacing between the forks desired for the load to be manipulated is adjusted and then the forks are pivoted downwardly to engage the respective dog 160 between a desired pair of the teeth 161.

Thereafter, when it is desired to side shift the forks in to alignment with a desired load, for example, sockets of a pallet, hydraulic fluid is fed to the cylinders 162, 163 to effect appropriate side shifting of the forks because of engagement of the dogs 160 between the pairs of adjacent teeth. Because the piston rods 162*a* 163 are linked as described hereinbefore then the forks 151, 152 will move sideways, ie. to the left or to the right together.

It will be appreciated that the hydraulic circuit to the cylinder 162, 163 is arranged accordingly. Each cylinder may be a single acting cylinder or a double acting cylinder as desired.

If desired the cylinders 162, 163 may not be linked by a rod 168 and the hydraulic circuitry may be arranged so that the cylinders may be operated independently so that the forks may be moved independently.

The present invention has the advantages that an additional carriage or carrier is not required, the total derating of the lifting ability of a machine equipped with the implement is limited essentially by the weight of the hydraulic actuators ie. piston and cylinder devices 162, 163 and these are essentially the only extra components of any significant weight required to be provided. Furthermore there is no additional load due to the weight of the sliding forks carrier usually associated with side shifting forks when they are provided as an additional component. Accordingly the load capacity of an operating machine is not reduced as a result of having to provide an additional carrier extending the load forwardly from that where it is normally carried and where it is carried in the present invention.

As mentioned above the forks can be easily engaged with or dis-engaged from the hydraulic actuators allowing the spacing of the forks to be adjusted to suit a desired load. Importantly, the forks may be dis-engaged so that they can be folded backwards over the carriage and retained by a suitable latch means, not shown, for safe road use.

Provision for fork retention is provided to eliminate inadvertent lateral fork movement in operation of the device by virtue of the above referred-to inter-engagement.

The features disclosed in the foregoing description, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

We claim:

1. A material handling implement comprising a carrier, a load engageable device slidably mounted on the carrier for movement relative thereto in a sideways direction, a side shift means mounted between the carrier and the load engageable device to cause movement of the load engageable device relative to the carrier in said sideways direction, and a bar mounted on the carrier for up and down movement relative to the carrier, wherein the bar extends transversely of the carrier and the load engageable device is mounted on the bar for said sideways sliding movement.

2. A material handling implement according to claim 1 wherein the load engageable device is movable relative to the side shift means and fixing means may be provided releasably to fix the load engageable device to the side shift means.

3. A material handling implement according to claim 2 wherein the fixing means comprises a first set of abutments mutually inter-engageable with at least one further abutment.

4. A material handling implement according to claim 3 wherein said first set of abutments and said at least one further abutment is fixed relative to one of said load engageable device and said side shift means respectively.

5. A material handling implement according to claim 2 wherein said fixing means comprises a dog movable with the load engageable device and releasably engageable with a plurality of teeth fixed relative to the side shift means.

6. A material handling implement according to claim 1 wherein side shift means comprises a fluid operated piston and cylinder device.

7. A material handling implement according to claim 1 wherein the bar is connected to the load engageable device arid the bar is mounted on the carrier such that the load engageable device is rotatable relative to the carrier.

8. A material handling device according to claim 3 wherein the bar is connected to the load engageable device and the bar is mounted on the carrier such that the load engageable device is rotatable relative to the carrier, and wherein the load engageable device is provided with one of said abutments.

9. A material handling implement according to claim 8 wherein the load engageable device is pivotable so as to move said abutments between an engaged and a disengaged position whereby the load engageable device may be positioned at a desired sideways position relative to the side shift means.

10. A material handling implement according to claim 7 wherein the bar is non-rotatably connected to the load engageable device.

11. A material handling implement according to claim 7 wherein the bar is rotatable relative to the carrier.

12. A material handling implement according to claim 1 wherein the load engageable device comprises a pair of sideways spaced elements for engagement with a load.

13. A material handling implement according to claim 12 wherein each element comprises a fork.

14. A material handling implement according to claim 13 wherein each fork comprises a generally downwardly extending limb connected adjacent one end to the bar and, having at or adjacent the other end, a forwardly extending tine for engagement with a load.

15. A material handling implement according to claim 14 wherein the side shift means comprises a pair of side shift elements each of which includes a piston and a cylinder device.

16. A material handling implement according to claim 15 wherein the pair of side shift elements are interconnected by a member which is non-slideably mounted relative to the carrier.

17. A material handling implement according to claim 16 wherein the inter connecting member is a member which provides a pair of piston rods one for each cylinder and is non-slideably connected to the carrier at a position adjacent its mid point.

18. A material handling implement according to claim 16 wherein the bar is connected to the load enageable device and the bar is mounted on the carrier such that the load engageable device is rotatable relative to the carrier and the bar is carried in a slot of a support member adjacent its mid point.

19. A material handling implement according to claim 16 wherein the bar is connected to the load engageable device and the bar is mounted on the carrier such that the load engageable device is rotatable relative to the carrier, and the member interconnecting the side shift means is carried in a slot of a support member adjacent its mid point.

20. A material handling implement according to claim 16 wherein the bar is connected to the load engageable device and mounted on the carrier such that the load engageable device is rotatable relative to the carrier, the member interconnecting the side shift means is carried in a slot of a support member adjacent its mid point and the bar is mounted in slots provided on the carrier, and adjacent its ends.

21. A material handling vehicle comprising a structure having ground engageable propulsion means and a material handling means comprising a boom mounted on the structure for raising and lowering swinging movement relative to the structure and driven for said raising and lowering movement by a first drive means and said boom being extendable and being driven for extension or retraction by a second drive means and a material handling implement according to claim 1 carried by an outer end part of said boom.

22. A material handling vehicle comprising a structure having ground engageable propulsion means and a material handling means comprising a boom mounted on the structure for raising and lowering swinging movement relative to the structure and driven for said raising and lowering movement by a first drive means and said boom being extendable and being driven for extension or retraction by a second drive means and a material handling implement according to claim 1 carried by an outer end part of said boom, wherein the material handling implement comprises a carrier and a load engageable device moveable relative to the carrier, a first sensing means to sense a first position of the device relative to the carrier, at least one of said first and second drive means being responsive to said first sensing means sensing said first position to modify operation of said one of said first and second drive means.

23. A material handling vehicle according to claim 22 wherein the material handling implement comprises a second sensing means to sense a second position of the device relative to the carrier and a control valve is operable in response to said second sensing means sensing said second position to modify operation of the other of said first and second drive means.

24. A material handling vehicle according to claim 23 wherein the vehicle comprises means to operate at least one of said first and second drive means to cause relative movement between said carrier and device and wherein said one of said first and second drive means is responsive to said first sensing means to cause or increase operation of the other of said first and second drive means.

25. A material handling vehicle according to claim 23 wherein the modification of operation of said one of said first and second drive means comprises cessation of operation of said one of said first and second drive means and initiation of operation of the other of said first and second drive means.

26. A material handling vehicle according to claim 23 wherein the rate of operation of said one of said first and second drive means is constant and operation of the other of said first and second drive means is initiated.

27. A material handling vehicle according to claim 23 wherein the rate of operation of the first and second drive means is variable so that the rate of operation of said one of the first and second drive means is decreased and the rate of operation of the other of said first and second drive means is increased or vice versa.

28. A material handling vehicle according to claim 23 wherein said first or said first and second sensing means comprise a proximity switch.

29. A material handling vehicle according to claim 23 wherein the first or first and second sensing means detect relative movement between the load engageable device and the carrier in a direction having a vertical translatory component.

30. A material handling vehicle according to claim 23 wherein one of the first and second sensing means detect angular movement of the load engageable device relative to the carrier.

31. A material handling vehicle according to claim 23 wherein the vehicle comprising a third sensing means to determine a predetermined orientation of the carrier relative to vertical.

32. A material handling vehicle according claim 23 wherein the vehicle comprises a mode sensing means to determine the angular orientation of the boom relative to vertical.

33. A material handling vehicle according to claim 32 wherein the mode sensing means modifies the response of the control valve to one of said first and second sensing means.

34. A material handling vehicle according to claim 23 wherein the vehicle comprises a control valve means under operator control to be operable to cause operation of at least one of paid first and second drive means for said engagement or disengagement of material handling implement.

35. A material handling vehicle according to claim 34 wherein the control valve means includes an operating lever, a position of which to extend a boom may be detectable and connectable to a control means so as to modify said operation of one of the first and second drive means.

36. A material handling vehicle according to claim 23 wherein the carrier is angularly adjustable relative to the boom for crowd or dump movement by a crowd drive means.

37. A material handling vehicle according to claim 23 wherein the carrier carries at least one of said first sensing means and said second sensing means to sense up and down movement of the load engageable device or rotation thereof about the axis of the bar.

38. A material handling implement according to claim 1 wherein the bar is releasably mounted on the carrier.

39. A material handling implement according to claim 1 wherein the carrier is provided with a pair of transversely spaced apart slots, the bar having at opposite ends thereof parts which are mounted in an associated slot for said up and down movement.

40. A material handling implement according to claim 39 wherein the carrier is provided with a manually operable latch member to retain, in an operative position thereof, one of said parts in its associated slot.

* * * * *

UNITED STATES PATENT AND TRADEMARK OFFICE

CERTIFICATE OF CORRECTION

PATENT NO. : 6,056,503

DATED : May 2, 2000

INVENTOR(S) : Richard Francis Way and David John Knight

It is certified that error appears in the above-identified patent and that said Letters Patent is hereby corrected as shown below:

Col. 12, claim 7, line 10, change "aird" to -- and
Col. 14, Claim 34, line 30, change "paid" to -- said Signed and Sealed this First Day of May, 2001

Nicholas P. Godici

*Attest:*

NICHOLAS P. GODICI

*Attesting Officer*

*Acting Director of the United States Patent and Trademark Office*